United States Patent [19]

Goldfarb et al.

[11] 4,395,041

[45] Jul. 26, 1983

[54] BALL TRANSFER AND CAPTURE GAME AND METHOD

[75] Inventors: Adolph E. Goldfarb, 4614 Monarca Dr., Tarzana, Calif. 91356; Emil H. Von Winckelmann, Van Nuys, Calif.

[73] Assignee: Adolph E. Goldfarb, Northridge, Calif.

[21] Appl. No.: 233,463

[22] Filed: Feb. 11, 1981

[51] Int. Cl.[3] ..... A63F 7/00

[52] U.S. Cl. ..... 273/119 A; 46/43

[58] Field of Search ..... 273/85 A, 118 R, 118 A, 273/119 R, 119 A, 120 R, 120 A, 121 R, 121 A, 122 R, 122 A, 123 R, 123 A, 124 R, 124 A, 125 R, 125 A, 142 E, 142 F, 142 H; 46/43

[56] References Cited

U.S. PATENT DOCUMENTS

| | | | |
|---|---|---|---|
| 2,610,853 | 9/1952 | Livingston | 273/121 R |
| 3,452,987 | 7/1969 | Di Motta | 273/121 A X |
| 3,592,471 | 7/1971 | Swimmer et al. | 273/120 R |
| 3,897,952 | 8/1975 | Breslow | 273/122 R |
| 4,052,068 | 10/1977 | Piacentino | 273/122 R |

*Primary Examiner*—Richard T. Stouffer

*Attorney, Agent, or Firm*—Romney, Golant, Martin, Disner & Ashen

[57] ABSTRACT

A game-playing method and apparatus, which includes a frame, one or more sets of balls, and a series of at least three wheels rotatably mounted adjacent to each other on the frame in a common horizontal plane. Each wheel includes a plurality of peripheral ball-carrying pockets having outwardly facing openings. A mechanism mounted in the frame effects continuous rotation of the wheels automatically circulating the balls from wheel to wheel in continuous movement. In particular, the balls are retained in the pockets of a rotating wheel except at transfer zones to adjacent wheels. A ball tends to move out of its pocket whenever it comes to a transfer zone and to pass through that zone to a receiving pocket on the adjacent wheel. If the receiving pocket is already occupied by another ball, no transfer occurs. A manually-actuated stop-gate enables a player to directly control the transfer of balls by blocking or unblocking at least one transfer zone. During the course of a typical game, the balls continuously travel along a path around the wheels and from wheel to wheel, and a player attempts to capture and retain certain balls in particular wheels by selectively opening and closing stop-gates.

22 Claims, 8 Drawing Figures

| | 1ST CYCLE | | | | | | | | | 4TH CYCLE | | | | | | |
|---|---|---|---|---|---|---|---|---|---|---|---|---|---|---|---|---|
| HOME WHEEL WITH 6 POCKETS - | 1 | 2 | 3 | 4 | 5 | 6 | 1 | 2 | 3 | 1 | 2 | 3 | 4 | 5 | 6 | 1 |
| INTERMEDIATE WHEEL WITH 8 POCKETS - | 1 | 2 | 3 | 4 | 5 | 6 | 7 | 8 | 1 | 3 | 4 | 5 | 6 | 7 | 8 | 1 |
| | 1 CYCLE | | | | | | | | | 3d CYCLE | | | | | | |

MATCHUP OF ALIGNED POCKETS

BALL TRANSFER AND CAPTURE GAME AND METHOD

BACKGROUND OF THE INVENTION

The invention relates generally to ball control games, and specifically to games where a player tries to control the travel of individual balls along several predetermined paths by changing the direction of the balls at a junction or cross-roads between paths.

The movement of balls along predetermined paths has been a traditional form of game used in so-called pin-ball machines where, typically, in individual player attemts to change the direction of the ball to direct it to an ultimate destination. Points are scored based on the success of the player in controlling the path of the ball. In a more useful device, the movement of balls along predetermined paths has been incorporated in decorative clocks where the location or directional movement by one ball causes a change of location or a change of movement by another ball.

However, at the present time, there has not been a successful attempt to combine the ball control features in the typical pin-ball machine, with the cause and effect relationship of a plurality of balls as used in a ball-clock. Also, most pin-ball machines do not lend themselves to competitive playing between a plurality of players, in which the activity of one player in directing the path of balls under his control may directly or indirectly effect the ability of a second player to direct the balls under his control along preferred paths.

Accordingly, it is an object of the present invention to provide a ball control game in which one or more players can exercise some control over the travel of a plurality of balls as they move continuously along predetermined paths, and particularly the transfer of balls from one point to another at junction points where the paths interconnect.

A more specific object is to provide a series of wheels mounted on generally vertical axes, and having ball-carrying pockets around their periphery, and a frame for mounting at least three such wheels in adjacent relationship so that, under certain conditions, upon rotation of the wheels, a ball may be transferred from the peripheral pocket of one wheel to the peripheral pocket of another wheel without stopping the rotation of the wheels.

It is a further object to provide a device having the aforementioned characteristics, which includes at least one manually actuated control gate between two of the adjacent wheels to prevent the transfer of any ball from one wheel to another when such control gate is closed. A related object is to provide at least one junction between adjacent wheels which does not have any manually activated control gate to selectively prevent a ball transfer, whereby a ball will be automatically transferred from the pocket of one wheel to the receiving pocket of an adjacent wheel, unless such receiving pocket is already occupied by another ball.

A further object is to provide a method and apparatus of the aforementioned characteristics, in which two home wheels of one diameter are mounted at opposite ends of a frame, and other differently sized wheels having a different number of carrying pockets are mounted in between the home wheels, with all the wheels in substantially the same horizontal plane, and with adjacent wheels rotating in opposite rotary directions to facilitate the transfer of a ball through a transfer zone between two adjacent wheels. The related object is to provide drive means and a gear train for controlling the rate of rotation of each of the wheels.

Other objects and advantages will become apparent to those skilled in the art based on a description of the preferred embodiment recited hereinafter, in conjunction with the accompanying drawings as follows:

DESCRIPTION OF THE PREFERRED EMBODIMENT

Figure 1:
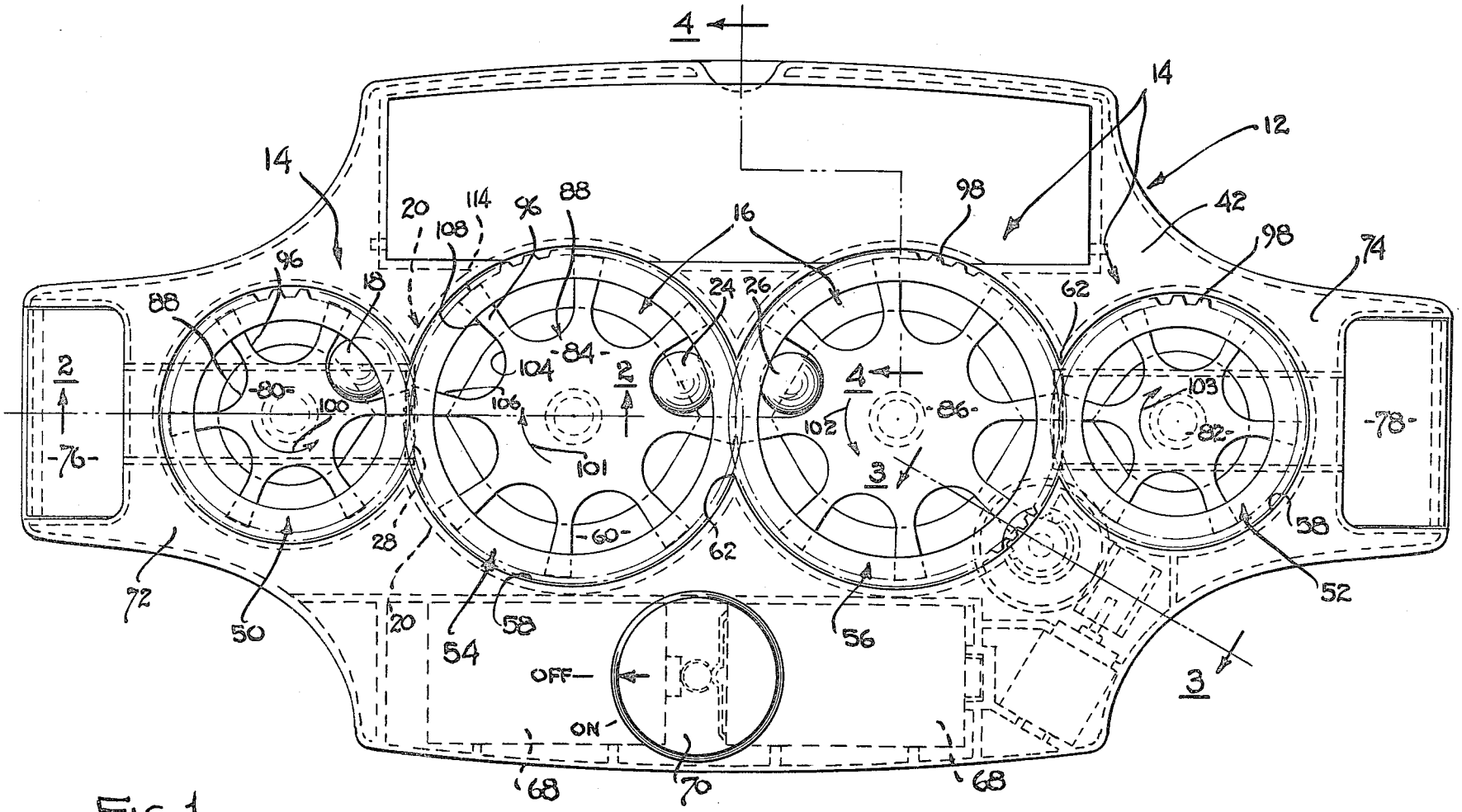
FIG. 1 is a top plan view of a presently preferred embodiment of the invention.

Broadly speaking, the invention as disclosed in the illustrated apparatus of the drawing comprises an elongated frame 12 for rotatably mounting at least three wheels 14 on vertical axes so that the wheels each move in substantially the same horizontal plane. The wheels have peripheral pockets 16 for carrying balls 18 held by each wheel. The wheels are continuously rotated to automatically circulate the balls along a circular path around each wheel as well as moving the balls from one wheel to another along an overall path in the shape of figure eights.

To accomplish this, each pocket is only partially enclosed and has a pocket opening which faces radially outward. The speed of rotation must be sufficient to create an appreciable centrifugal force which tends to throw the ball out of the pocket opening. Each wheel is mounted adjacent to at least one other wheel so that during rotation, the peripheral pockets of one wheel pass by in close proximity to the peripheral pockets of an adjacent wheel. A pair of side walls 20 define a junction or transfer zone 22 between adjacent wheels, and the side walls and pocket openings are sized and shaped to prevent more than one ball from passing through the transfer zone. Thus, when a rotating wheel is carrying a first ball 24 in one of its peripheral pockets, the resulting centrifugal force impels such first ball outwardly to pass through the transfer zone to an empty receiving pocket in the adjacent wheel. If the receiving pocket is already occupied by a second ball 26 (see FIG. 1), the first ball will abut against the second ball and therefore will be forced to remain in its original pocket for continutravel in the same wheel. Similarly, the second ball will rebound against the first ball and also be prevented from passing through the transfer zone.

Figure 2:
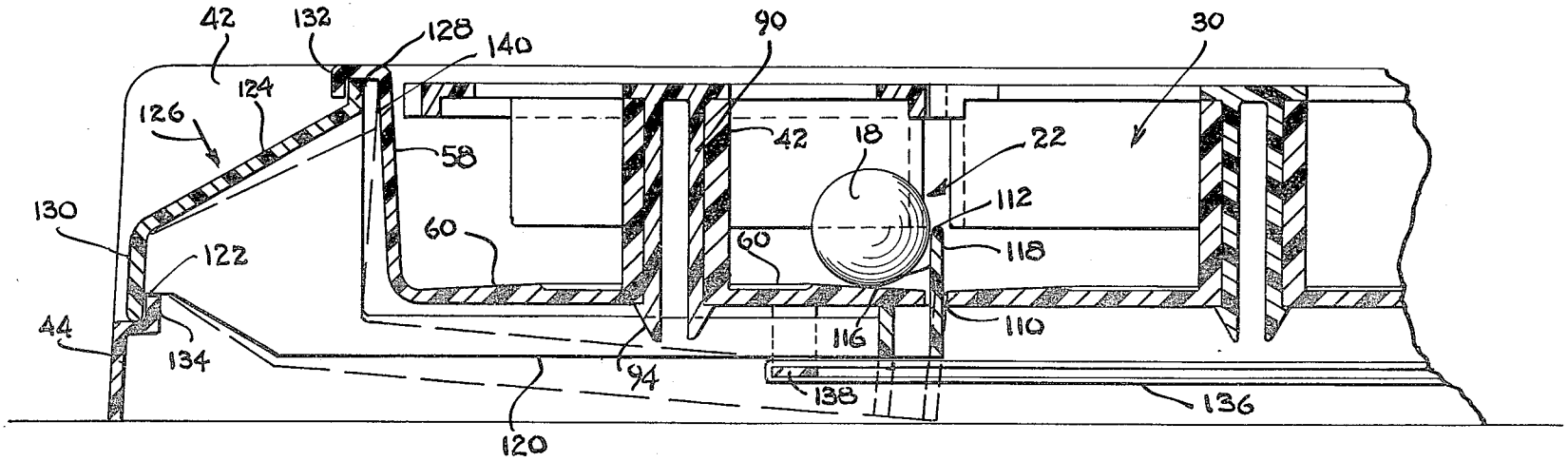
FIG. 2 is an enlarged vertical sectional view taken along the line 2—2 of FIG. 1 and showing a stop-gate in closed position preventing the transfer of a ball from one wheel to another.
Figure 5:
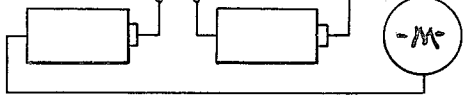
FIG. 5 is a schematic circuit diagram for providing electrical power to the drive mechanism of FIG. 3.
Figure 4:
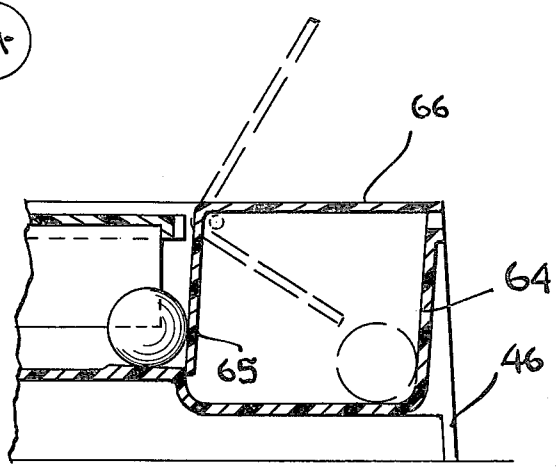
FIG. 4 is an enlarged vertical sectional view taken along the line 4—4 of FIG. 1 showing an exit gate and storage container.

At least one of the transfer zones includes a manually actuated stop-gate 28 which can be moved between an open and closed position. As best shown in FIG. 2, when the stop-gate is closed, the ball 18 will be prevented from passing through such transfer zone into a receiving pocket 30 of an adjacent wheel even when such receiving pocket is empty. Thus, a transfer will occur only if both necessary conditions are satisfied—namely (a) the stop-gate is open; and (b) the receiving pocket is empty.

In the preferred form disclosed herein, the frame is designed for mounting two home wheels at opposite ends of the frame, and for mounting two intermediate wheels therebetween. Adjacent wheels go in opposite rotary directions. This facilitates the smooth exchange of balls between adjacent wheels by allowing more time for passing a ball through the transfer zone and also by avoiding sharp changes of direction by a ball passing through the transfer zone. The transfer zones connecting each home wheel with its adjacent intermediate wheel each have a manually operated stop-gate, thereby enabling a player operating the stop-gate to have overriding control over any ball captured in one of the home wheel pockets. In contrast, there is no way to directly open or close the transfer zone between the adjacent portions of the intermediate wheels, since this is determined solely by the presence or absence of a ball in a receiving pocket.

In a typical form of the game, one set of balls is provided in a color associated with the first player and a second set of balls is provided in a different color associated with the second player. Each player is assigned his own home wheel and has control over its manually actuated stop-gate. By selectively opening and closing this stop-gate, the player can choose whether or not to prevent the entrance and exit of his own balls as well as his opponent's balls across the transfer zone which is in communication with his own wheel. In order to provide more sophistication, the intermediate wheels are of larger diameter and have a greater number of peripheral pockets than the home wheels. Thus, a ball which leaves a given pocket from a home wheel and completes a full revolution around one or more of the intermediate wheels will match up with a different pocket when it returns to the transfer zone for the home wheel. The game therefore calls for some advance planning as to the consequences of accepting or discharging a ball in or out of one's home wheel. The game also requires carefully controlled eye/hand coordination. For example, where the object of the game is to capture only your own colored balls in your home wheel, opening a stop-gate prematurely may inadvertently release one of your own colored balls or alternatively accept one of your opponent's colored balls thereby making it important to match the opening and closing of your own stop-gate with the desired increment of time when the ball to be transferred is coming into the transfer zone.

Since there are a number of variables which are constantly changing the location of the two sets of colored balls among the peripheral pockets of the four wheels, the invention provides an exciting and entertaining competitive game. In that regard, it requires great concentration to visually monitor the location of all the balls in the preferred embodiment as they travel continuously around each wheel along six different semi-circular paths 31, 32, 33, 34, 35, 36 and from time to time automatically change wheels at three different junctions 38, 39, 40 (see FIG. 6). Of course, it is possible to vary the size, location, speed and rotational direction of each individual wheel and its pockets, as well as the relative positioning of wheels and their junctions, to provide countless permutations and combinations of variables which incorporate the unique method and apparatus of the present invention.

Figure 3:
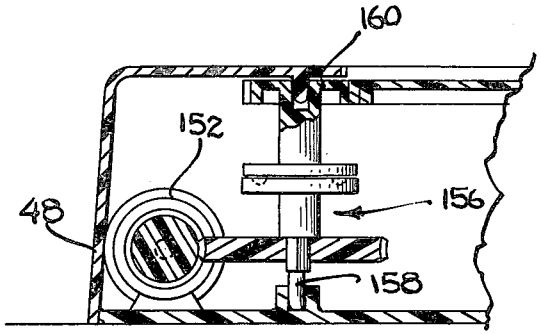
FIG. 3 is an enlarged vertical sectional view taken along line 4—4 of FIG. 7 showing the wheel drive mechanism.

Referring more specifically to the exemplary embodiment, the frame 12 constitutes an elongated platform 42 supported on a table or floor by end legs 44, side legs 46, and auxiliary legs 48 situated as needed at various points around the platform. A series of four overlapping circular recesses extend in a row in the longitudinal direction on the platform, including two small diameter recesses 50, 52 at either end of the platform and two larger diameter recesses 54, 56 in linear alignment therebetween. An upstanding outer wall 58 defines the outside boundary of all four recesses, collectively, and provides a guide for balls which move along a floor 60 of the recesses in a figure-eight raceway, as described in more detail below. The side walls 20 which define the boundaries of the transfer zone mark the junction point between each pair of adjacent recesses. A ball storage compartment comprising a cup 64 and a pivotably attached lid 66 may be included on one side of the platform adjacent to one or both of the larger recesses. The lid may be directly connected to an exit gate 65 from the adjacent raceway. Thus, lifting the lid opens the gate, allowing collection of any balls traveling along the raceway at the end of a game. A drive mechanism including batteries 68 and a manual on-off switch 70 may be located on the other side of the platform for activating the drive mechanism of FIG. 3. The ends of the platform 72, 74 are extended to form two player stations and include cut-outs for a player-actuated button 76, 78. Thus, the game apparatus is self-contained for moving from one place to another, or for storage when not in use.

The wheels 14 are sized and shaped to fit in the different recesses and include smaller diameter home wheels 80, 82 and larger diameter intermediate wheels 84 and 86. Each wheel includes a hub 88 and an axle 90 which is journaled inside an upright cylindrical shaft 92 which extends above the floor of each recess, with outwardly directed flanges 94 at the bottom of the axle for rotatably and securely mounting each wheel about an upright axis, and in a common horizontal plane. Extending outwardly from the hub are a plurality of arms 96 forming the previously mentioned peripheral pockets 16 for carrying the balls 18. Each wheel includes gear teeth 98 on the outer periphery which are directly meshed with matching gear teeth on adjacent wheels, with the vertical distance between the gear teeth and the floor of the recess being greater than the diameter of the balls 18. This direct gearing provides for synchronized rotation of the wheels such that adjacent wheels rotate in different rotary directions 100, 101, 102 and 103. Also, the wheel peripheries pass each other at the same rate of speed, even though the rotary rate of speed (rpm's) for the larger intermediate wheels 84 and 86 is less than for the smaller diameter home wheels 80, 82.

Figures 8, 8E:
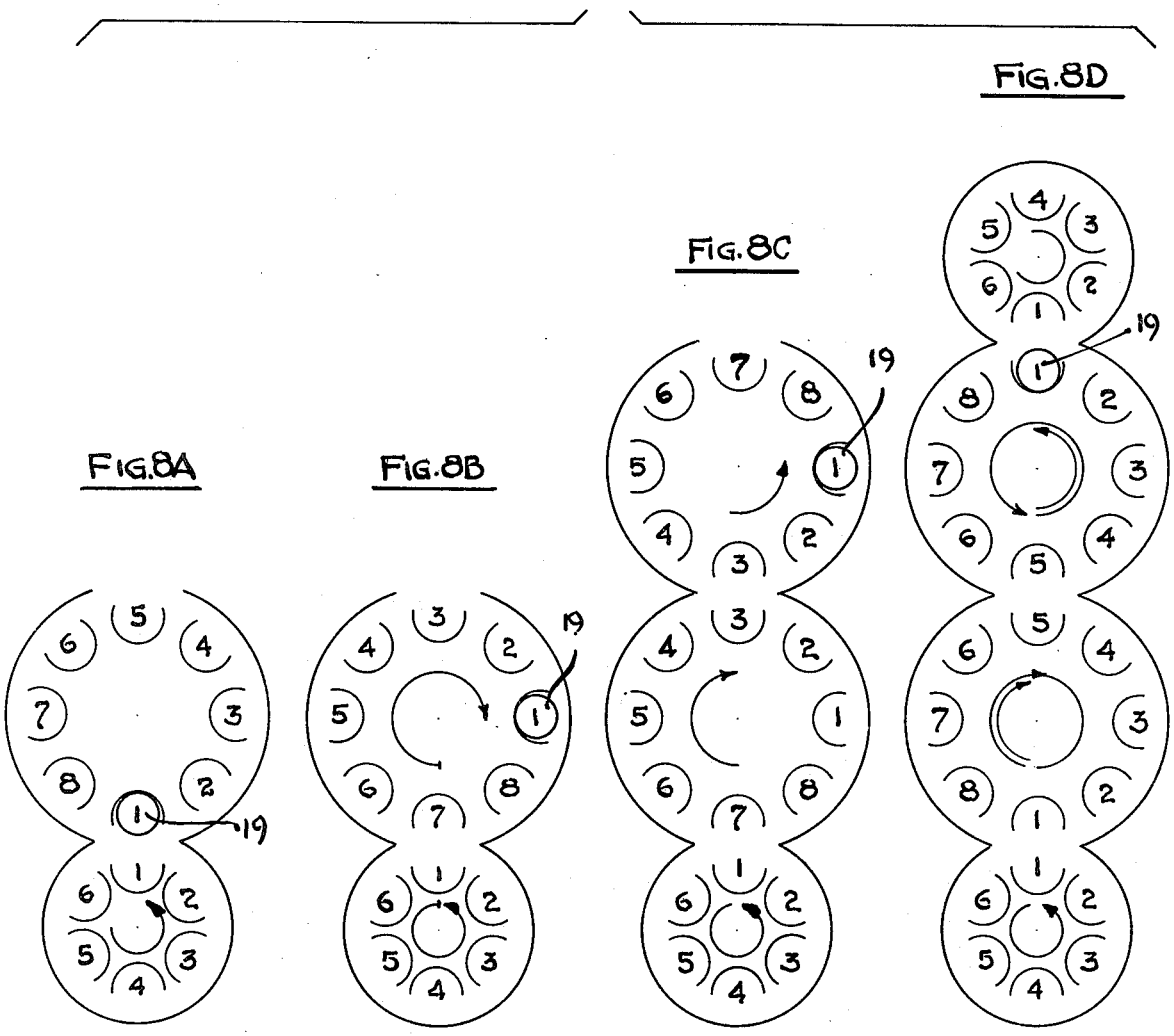
FIG. 8 is a schematic diagram showing the sequence of match-ups between adjacent pockets on wheels having differing numbers of pockets evenly spaced about their periphery with the portions of the sequence identified as FIGS. 8A, 8B, 8C, and 8D, respectively.

It is an important feature of the invention that different pairs of pockets align across the transfer zone after each complete revolution of the wheel. This is shown more clearly in the schematic drawing, and table of FIG. 8, where pockets have been given identification numbers. For example, as shown in the table, in comparing FIG. 8A with FIG. 8B, a ball transferred out from the home wheel pocket #1 will have only passed three/fourths of the way around the adjacent intermediate wheel by the time the wheel has completed its first cycle. It will ultimately take four complete cycles of the home wheel and three complete cycles of the intermediate wheel to bring the ball back in alignment with its original pocket #1 in the home wheel for possible reentry there. Moreover, in the exemplary embodiment, which includes two intermediate wheels having the same number of pockets, a single cycle of the home wheel will bring the ball 19 halfway around the first intermediate wheel and one quarter of the way around the second intermediate wheel (See FIG. 8C). As shown in FIG. 8D, upon completion of four cycles by the home wheel, the ball will have traveled one and one-half times around the first intermediate wheel and one and one-half times around the second intermediate wheel to the transfer zone for the opposite home wheel (See FIG. 8E). It will further be observed from FIG. 8, that all the even numbered pockets constitute one independent set and the odd numbered pockets constitute another independent set, and balls which start in even numbered pockets will always remain in even numbered pockets even though they pass in circular and semi-circular paths around all four of the wheels. Thus, in one version of the game where six balls of one color are in one home wheel and six balls of another color are in the opposing home wheel, it will be possible to effect an exchange of all balls between home wheels. However, in a different version of the game where balls are fed into the pockets of the intermediate wheels, it is possible than an even distribution between odd and even numbered pockets might not be achieved, thereby making it impossible to get all six balls of one color into one of the home wheels. In such a game, the player first capturing five balls could be considered the winner.

Figure 6:
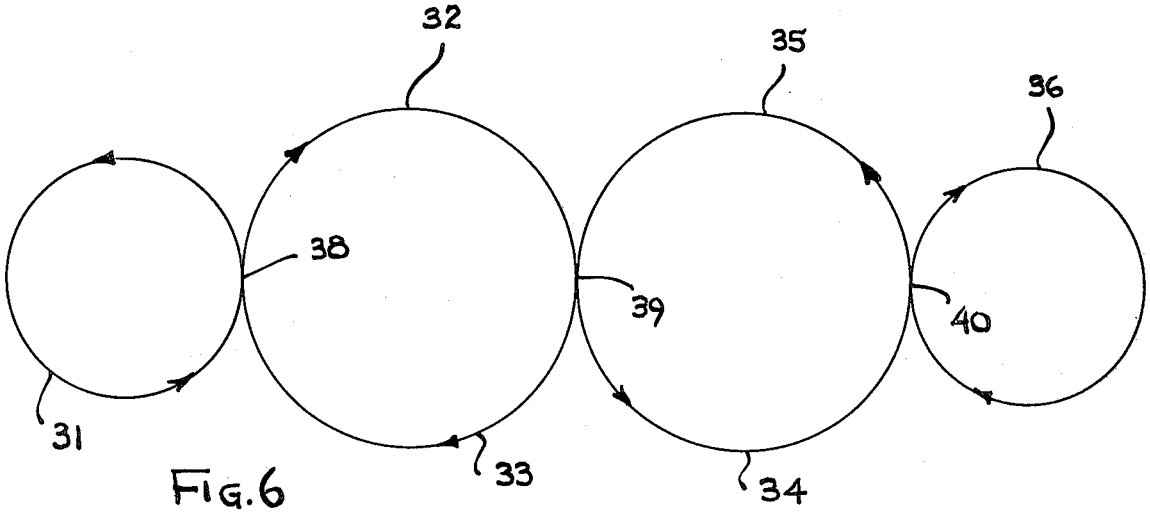
FIG. 6 is a schematic diagram showing the paths of travel for the balls in the illustrated embodiment of the invention.

In order to facilitate transportation of the balls along the circular and semi-circular paths of FIG. 6, the pockets include an arcuate back wall 104 which extends outwardly in flared fashion to form a push wall 106 and a catch wall 108, with the bottom of the pocket being formed by the recess floor 60. Thus, the combination of the pocket, raceway and transfer zone structure designed to perform five separate functions:

(1) rolling the ball along the raceway formed by the floor 60 and the outer guide wall 58; in this step, the direct contact between the push wall 106 and the ball moves it forwardly, while the arms 96 are spaced sufficiently apart to allow the ball to freely move as necessary back and forth between the catch wall and the push wall as it rolls smoothing along the raceway in its semi-circular path;

(2) impelling the ball out of the pocket of the delivering wheel and through the transfer zone formed between the inwardly extending corners 62;

(3) capturing the ball in the receiving pocket and moving it past the leading edge of the corner 62; in this step it is important that any rebounding off the catch wall or back wall of the receiving pocket will not return the ball backwards through the transfer zone into the delivering wheel;

(4) rolling the ball past the transfer zone without passing there-through when the aligned pocket in the receiving wheel is already occupied by a ball; and (5) rolling the ball past the transfer zone without passing there-through when the stop-gate 28 is in closed position.

Referring more specifically to the structure and operation of the stop-gate 28, the floor 60 of the transfer zone 22 includes a vertical slot extending between the two opposing corners 62. The stop-gate itself is formed of a plate appreciably shorter than the length of the slot and not as thick as the slot to provide frictionless vertical movement of the stop-gate up and down through the slot. The stop-gate is held in a normally closed position, with its upper edge 112 extending up the distance approximately one-half the diameter of the ball, and leaving a gap between its top edge and the bottom of the gear teeth 98 which gap is less than the diameter of the ball. The slot is positioned so that when the stop-gate is in closed position, the outer edge of the arms 114 during rotation will clear the gate without any touching. Thus, both sides of the gate 116 and 118 constitute a blocking surface for blocking any ball from going through the transfer space when the gate is in closed position.

In referring more specifically to FIG. 2, the stop-gate is carried on the forward end of a lever arm 120 which extends from the slot to the cut-outs at the end of the platform where the rear end of the lever arm pivotally rests on a fulcrum point 122 which constitutes an upward extension of the end leg 44. The button 76 extends across the platform cut-out and is angularly disposed to provide an inclined surface 124 for manually pushing in the direction shown by arrow 126. The button is bent at its forward and rearward ends to form vertical lips 128 and 130 to interlock under a downward flange 132 and an upward flange 134, respectively. In this regard, the ledge formed by the downward flange 132 constitutes an upper limit for the button. A resilient band 136 extends from a downwardly extending mounting pin 138 across to a matching mounted pin (not shown) at the other end of the platform to constitute a biasing means for holding the stop-gate in a normally closed position. A stop member limiting the downward movement of the lever arm may be provided for the button at point 140 or alternately by an additional stop (not shown) at the forward end of the lever arm which prevents the lever arm from further downward movement as soon as the upper edge of the stop-gate withdraws down below the surface of the raceway floor. This construction enables the small downward push on the button to cause a large downward movement at the forward end of the lever arm, thus providing for sensitive control of the stop-gate.

Figure 7:
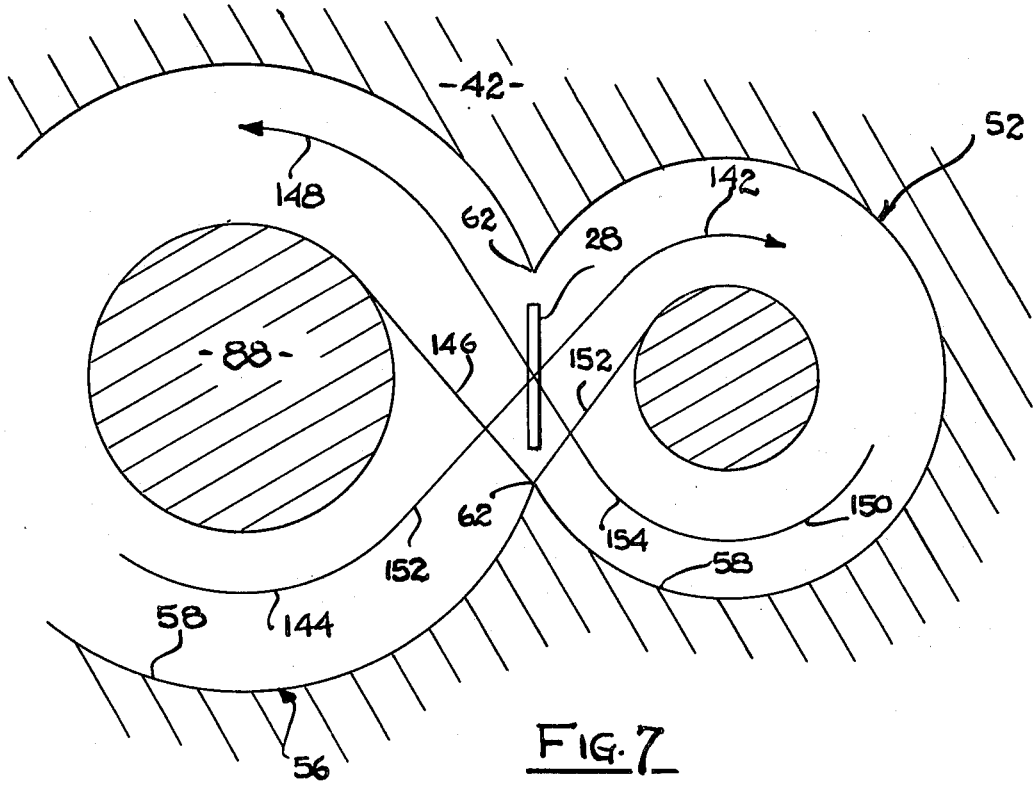
FIG. 7 is an enlarged top plan view showing the details of a raceway at the entrance to and an exit from the transfer zone.

When a ball moves along the raceway formed in recess 56, through the transfer zone with the stop-gate 29 open, it will proceed along the lines shown by directional arrow 142 (See FIG. 7). In order to facilitate the movement of the balls across the transfer zone, the portion of the raceway leading into the transfer zone is contoured to provide an upward incline at 144, and then a sharp ledge or drop-off at point 146 to help impell the ball through the transfer zone into the raceway of recess 52. The contour of the raceway on the first semi-circle of recess 142 is relatively unimportant, but as the raceway path comes into the second half and begins to approach the transfer zone along the directional arrow 148, it will again proceed along an upward incline in the general vicinity of 150, and a sharp decline in the form of a ledge at 152. It will be further noted that the ledge 152 serves as a directional guide for the ball traveling along path 142, and that ledge 146 serves as a directional guide for the ball traveling along path 148. Additional contouring may include a radially outwardly decline at points 152 and 154 in order to assure that the ball is against the outer guide wall 58 as it approaches the transfer zone. Of course, if the stop-gate 28 is in closed position, the effect of the contouring is nullified and each ball remains in its same pocket and continues its circular path in the same recess.

Rotation of the wheels is effected through a motor 156 mounted on an upright shaft 158 carrying a cog wheel 160 at its top which engages one of the wheels 14 as at 162. It was found that the rotation rate of intermediate wheels was preferably at about 40 rpm. Based on experimentation, 55 rpm made it too difficult to react in time to activate the stop-gate, and less than 25 rpm made the game too easy, while 11 rpm did not provide sufficient centrifugal force to successfully transfer and avoid jams at the transfer zone.

It will be appreciated that in addition to the specific structure and method described here respecting the exemplary embodiment, other modifications and variations could be made without departing from the spirit of the invention. It is noted that the form of invention shown in the drawing includes open-topped pockets so that the balls can be manually dropped into each pocket as desired at the start of each game. However, it is within the spirit of the invention to include a feed mechanism in the frame for feeding the balls one at a time into the pockets. In this regard, it may provide a greater variation to feed such balls into the intermediate wheels rather than starting at the end wheels. Also, it may be possible to have pockets whereby the balls are held by a wheel bottom rather than rolled along the raceway, although this method is not believed to be as effective as the rolling raceway shown in the preferred embodiment. Also, although balls are not necessarily required, the use of balls seems to be essential for this particular device to get sufficient centrifugal force and ease for transfer between wheels. Of course, the orientation of the wheels could be varied considerably, including a large intermediate wheel having a plurality of home wheels adjacent thereto around the periphery, as well as different intermediate wheels with different numbers of pockets and so forth. Also, the gears which are directly included on the wheels could be in the housing below, and the stop-gate could move back and forth into position from above or the side of the transfer zone.

Other changes could be made to the illustrated structure and method without departing from the spirit and scope of the present invention as set forth in the following claims.

I claim:

1. A competitive multi-player game-playing apparatus, comprising:

a frame means;

a plurality of sets of balls, each set distinctively marked for association with each player;

at least three wheels, mounted in the frame means such that each wheel is adjacent to at least one other wheel and is rotatable about a vertical axis, including at least one wheel associated with each player, and at least one wheel intermediate the player-associated wheels, each wheel including a plurality of peripheral pockets, each proportioned and arranged so as to receive and carry a ball and permit a ball to pass outwardly;

motor means mounted in the frame means for effecting simultaneous rotation of all of said wheels, each at a rate of rotation which generates sufficient centrifugal force such that the balls tend to move out of the pockets, and wherein the rates of rotation of the wheels are syncronized and the respective sizes of the wheels, and the proportions and arrangements of the pockets are designed such that a space is formed between pockets in adjacent rotating wheels through which a ball tend to transfer;

means on the frame means for confining the balls in the pockets in the rotating wheels other than at the transfer spaces, so that a ball will move through a path about the periphery of the rotating wheel between transfer spaces; and means mounted in the frame means for controlling transfer of balls through at least one transfer space, said control means being operable by each player.

2. A competitive multi-player game-playing apparatus, comprising:

a frame means;

a plurality of sets of balls, each set distinctively marked for association with each player;

at least three wheels, mounted in the frame means such that each wheel is adjacent to at least one other wheel and is rotatable about a vertical axis, including at least one wheel associated with each player, and at least one wheel intermediate the player-associated wheels, each wheel including a plurality of peripheral pockets, each proportioned and arranged so as to receive and carry a ball and permit a ball to pass outwardly;

means mounted in the frame means for effecting rotation of the wheels at a rate of rotation which generates sufficient centrifugal force such that the balls tend to move out of the pockets, and wherein the rates of rotation of the wheels, the respective sizes of the wheels, and the proportions and arrangements of the pockets are designed such that a space is formed between pockets in adjacent rotating wheels through which a ball tends to transfer;

means on the frame means for confining the balls in the pockets in the rotating wheels other than at the transfer spaces, so that a ball will move through a path about the periphery of the rotating wheel between transfer spaces; and means mounted in the frame means for controlling transfer of balls through at least one transfer space, said control means being operable by each player, the controlling means comprising a plurality of gates, at least one gate associated with each player and including a vertical blocking plate, movable relative to a transfer space responsive to manual actuation so as to block or unblock the transfer space.

3. The game apparatus of claim 2 in which each gate further includes a manually-operable button, a lever arm interconnecting the manually-operable button and the vertical blocking plate, and a fulcrum in the frame about which the lever arm is pivoted.

4. The game apparatus of claim 3 in which the distance along the lever arm from the fulcrum to the manually-operable button is substantially less than the distance along the lever arm from the fulcrum to the vertical blocking plate.

5. The game apparatus of claim 2, in which the gate is biased so as to normally block a transfer space.

6. The game apparatus of claim 5, in which the biasing means comprise a resilient member, interconnected between the gate and the frame.

7. The game apparatus of claim 1, further comprising an auxiliary collector means that includes an exit gate for collecting balls from the wheels; and a container in the frame means into which the balls may be selectively fed through the exit gate.

8. A game playing apparatus controlling movement of a plurality of balls along predetermined paths which intersect at two or more junctions, comprising:

a frame;

a wheel means mounted on said frame and including a plurality of wheels, each mounted for rotation in a common horizontal plane and with each wheel adjacent to at least one other wheel across a transfer zone, for moving said balls along circular paths around the wheels and from wheel to wheel, and including at least one wheel different in diameter from the other wheels;

ball-holding means including a plurality of peripheral pockets sized and shaped to hold a ball and for releasing said ball through a transfer zone to an empty pocket of an adjacent wheel;

guide means on said frame for confining the balls in said pockets of said rotating wheels other than at said transfer zones;

motor means mounted on said frame means for simultaneously rotating all of said wheels, each at a constant speed which is synchronized with the speed of the other wheels and which is sufficient to tend to automatically move a ball out of said peripheral pockets and through said transfer zones to an empty pocket on an adjacent wheel, the different sizes of the wheels being such that pockets in adjacent rotating wheels are not aligned in the same pairs upon each complete rotation of a wheel; and manually actuated gate means in at least one of said transfer zones for blocking passage of any ball through such transfer zone.

9. The game apparatus of claim 8 in which adjacent wheels rotate in opposite directions.

10. The game apparatus of claim 8 in which each of said pockets is proportioned so as to receive and hold not more than one ball.

11. The game apparatus of claim 8, further including a contoured path in the frame means, for accelerating movement of the balls towards each transfer zone.

12. The game apparatus of claim 8, in which the wheels themselves include gear means for directly synchronizing their rotation at a constant rate.

13. A game playing apparatus controlling movement of a plurality of balls along perdetermined paths which intersect at two or more junctions, comprising:

a frame;

a wheel means mounted on said frame and including a plurality of wheels, each mounted for rotation in a common horizontal plane and with each wheel adjacent to at least one other wheel across a transfer zone, for moving said balls along circular paths around the wheels and from wheel to wheel, and including at least one wheel different in diameter from the other wheels;

ball-holding means including a plurality of peripheral pockets sized and shaped to hold a ball and for releasing said ball through a transfer zone to an empty pocket of an adjacent wheel;

guide means on said frame for confining the balls in said pockets of said rotating wheels other than at said transfer zones;

drive means mounted on said frame means for rotating each of said wheels at a constant speed which is sufficient to tend to automatically move a ball out of said peripheral pockets and through said transfer zones to an empty pocket on an adjacent wheel, the different sizes of the wheels being such that pockets in adjacent rotating wheels are not aligned in the same pairs upon each complete rotation of a wheel; and manually actuated gate means in at least one of said transfer zones for blocking passage of any ball through such transfer zone, the wheels themselves include gear means for directly synchronizing their rotation at a constant rate, the wheels each including gear teeth on its outer periphery which are directly meshed with gear teeth in adjacent wheels, and wherein the vertical distance between the wheel gear teeth and the bottom of the wheel path is greater than the diameter of a ball.

14. The game apparatus of claim 8, in which the frame includes floor means under the circular paths of the balls and adjacent the guide means; and wherein the wheels each include a plurality of radially extending arms defining side walls of the pockets to form with said floor means each ball carrying pocket.

15. The game apparatus of claim 14 wherein the side walls of the pockets are formed into an outwardly tapered U-shape to permit and assist the balls in entering to or exiting from said transfer zones.

16. A game playing apparatus, for directing movement of a plurality of balls, comprising:

a frame member including upper means forming a series of at least three overlapping circular recesses having generally horizontal floor means and upstanding outer guide wall means for defining a ball raceway path such that each adjacent pair of recesses forms a figure-eight;

at least three wheels, each mounted in one of the adjacent circular recesses for rotation about generally vertical axes, each wheel including a plurality of peripheral ball-carrying pockets for rolling the balls along said raceway, each pocket including an outwardly facing opening for discharging or receiving a ball passing through a transfer zone at the junction points on said figure-eight raceway path;

a drive mechanism including a motor means mounted on said frame means for effecting simultaneous rotation of all of said wheels, each at a rate of rotation which generates sufficient centrifugal force such that the balls tend to move automatically out of said peripheral pockets and through a transfer zone to pockets on adjacent rotating wheels; and gate means mounted in said frame means in at least one transfer zone between adjacent rotating wheels, and including a manually actuated button member actuating the gate means to block the transfer of any balls through such transfer zone.

17. The game apparatus of claim 16 in which the outer guide wall means includes a pair of inwardly projecting corners at side boundaries of each transfer zone for diverting balls into and out of the transfer zone without jamming the rotation of the wheels.

18. The game apparatus of claim 16, further comprising a contoured path in the portion of the floor means leading into the transfer zone for guiding and accelerating movement of the balls.

19. The game apparatus of claim 18, wherein said contour means includes a decline at the entrance of the transfer zone.

20. A method of moving a plurality of balls unidirectionally along a figure eight route having a first circular path, a second circular path and a junction therebetween, including the steps of:

automatically by use of a motor and continuously directing certain of said balls in a linear sequence around the first path one at a time past the junction;

automatically by use of a motor and simultaneously and continuously directing certain others of the said balls in a linear sequence around the second path one at a time past the junction;

transferring to a different path automatically any ball passing the junction when another ball is not already occupying the different path at the junction; and selectively blocking the junction point during different spaced time periods to prevent any ball from going through said junction to a different path.

21. The method of claim 20 wherein said directing steps include directing balls around the first and second paths in different directions, respectively.

22. The method of claim 20 wherein the time for a ball completing one complete cycle around the first path is greater then the time for completing one complete cycle around the second path.

* * * * *